US006676447B1

(12) United States Patent
Knox

(10) Patent No.: US 6,676,447 B1
(45) Date of Patent: Jan. 13, 2004

(54) POTHEAD CONNECTOR WITH ELASTOMERIC SEALING WASHER

(75) Inventor: Dick L. Knox, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/198,346

(22) Filed: Jul. 18, 2002

(51) Int. Cl.[7] ..... H01R 13/40
(52) U.S. Cl. ..... 439/587; 439/274; 439/279
(58) Field of Search ..... 439/587, 588, 439/589, 274, 275, 278, 271

(56) References Cited

U.S. PATENT DOCUMENTS

| | | | | |
|---|---|---|---|---|
| 2,311,805 A | | 2/1943 | Yost | |
| 3,308,316 A | | 3/1967 | Pfahl | |
| 4,053,196 A | | 10/1977 | Dunaway | |
| 4,128,735 A | | 12/1978 | Zehren | |
| 4,626,721 A | * | 12/1986 | Ouchi | 310/71 |
| 4,959,022 A | | 9/1990 | Neuroth | |
| 4,965,409 A | | 10/1990 | Lindroos | |
| 5,221,214 A | | 6/1993 | Martin | |
| 5,700,161 A | * | 12/1997 | Plummer et al. | 439/587 |
| 5,704,799 A | | 1/1998 | Wood | |
| 5,801,465 A | | 9/1998 | Yamada | |
| 6,071,148 A | | 6/2000 | Radliff et al. | |
| 6,361,342 B1 | * | 3/2002 | Cox | 439/275 |

FOREIGN PATENT DOCUMENTS

| | | |
|---|---|---|
| EP | 0660447 B1 | 6/1995 |
| EP | 0660447 A1 | 6/1995 |

* cited by examiner

*Primary Examiner*—Truc Nguyen
(74) *Attorney, Agent, or Firm*—Bracewell & Patterson, LLP

(57) ABSTRACT

A pothead connector for an electrical submersible pump motor includes a housing. A first insulating block is disposed within the housing and has passages for receiving insulated conductors of the power cable. The passages in the first insulating block have counterbores on an second end. A second insulating block is also disposed within the housing. The second insulating block has passages through which the insulated conductors pass. The second insulating block also has protrusions on a first face that are concentric with the counterbores and shaped to fit within the counterbores in the first insulating block. An elastomeric washer is positioned within each of the counterbores. A fastener rigidly secures the second insulating block to the first insulating block, forcing the protrusions against the elastomeric washers to cause the washers to seal around the insulated conductors.

17 Claims, 2 Drawing Sheets

POTHEAD CONNECTOR WITH ELASTOMERIC SEALING WASHER

BACKGROUND OF THE INVENTION

1. Field of the Invention

The present invention relates generally to downhole electrical connectors for use in oil field applications. More specifically, the present invention relates to a pothead connector for connecting an insulted power cable to the motor of an electric submersible pump.

2. Description of the Related Art

Downhole electric submersible pumps are driven by electric motors. The electric motor is powered from the surface, so a cable must be fed down the well to the pump motor. Prior to lowering the motor, a motor lead of the cable is attached with what is known in the art as a pothead connector. The pothead connector secures the motor lead to the motor so that it is not loosened as it is lowered. The pothead connector must also be able to withstand the downhole environment, which may include caustic materials under high pressure and temperatures. The service life of the pothead connector depends on its ability to seal effectively.

Various sealing techniques and cable securing means have been used. Typically, a metal housing is used for the connector. An insulating block mounts inside the housing. The insulating block has passages for receiving the insulated conductors. Electrical contact pins are secured to each conductor and protrude from the forward side of the insulating block. Epoxy is filled in the spaces around the conductors within the housing to seal the conductors and secure them. The housing has an integral cylindrical lip that protrudes past the insulating block for reception in a mating receptacle.

SUMMARY OF THE INVENTION

In accordance with the present invention, a pothead connector is provided with a protective housing near the terminal end of a motor lead. In all of the embodiments, an insulating block is mounted in the housing. The insulating block has at least one hole therethrough for receiving an insulated electrical conductor. An electrical contact pin is secured to the conductor within the insulating block and protrudes from the insulating block. A cylindrical wall or lip is integrally formed on the insulating block and protrudes past a first end of the housing. A seal is located on the outer diameter of the lip.

In another embodiment, the insulating block has a counterbore in a second end. A second insulating block is also disposed within the protective housing. The second insulating block has a passage through which the insulated conductor passes. The second insulating block also has a protrusion on a lower face that is concentric with the counterbore and shaped to fit within the counterbore in the first-mentioned insulating block.

An elastomeric washer is positioned within the counterbore at the second end of the passage in the first insulating block. The elastomeric washer has a hole through which the insulated conductor passes. A fastener rigidly secures the second insulating block to the first insulating block, forcing the protrusion against the elastomeric washer to cause the washer to seal around the insulated conductor. The elastomeric washer will also effectively secure the insulated conductor in the protective housing.

The fastener may take the form of a shoulder engaging the second end of the second insulating block coupled with a retaining ring engaging the first insulating block. Alternatively the fastener may be a threaded connector between the two insulating blocks. A threaded connector could include a spring to compensate for thermal expansion.

In still another embodiment, the insulating block is formed of a thermoplastic material that is compatible with a thermoplastic insulating layer on the conductors. After installation in the holes, the insulating layer is heat fused to the insulating block.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DESCRIPTION OF THE INVENTION

Figure 1:
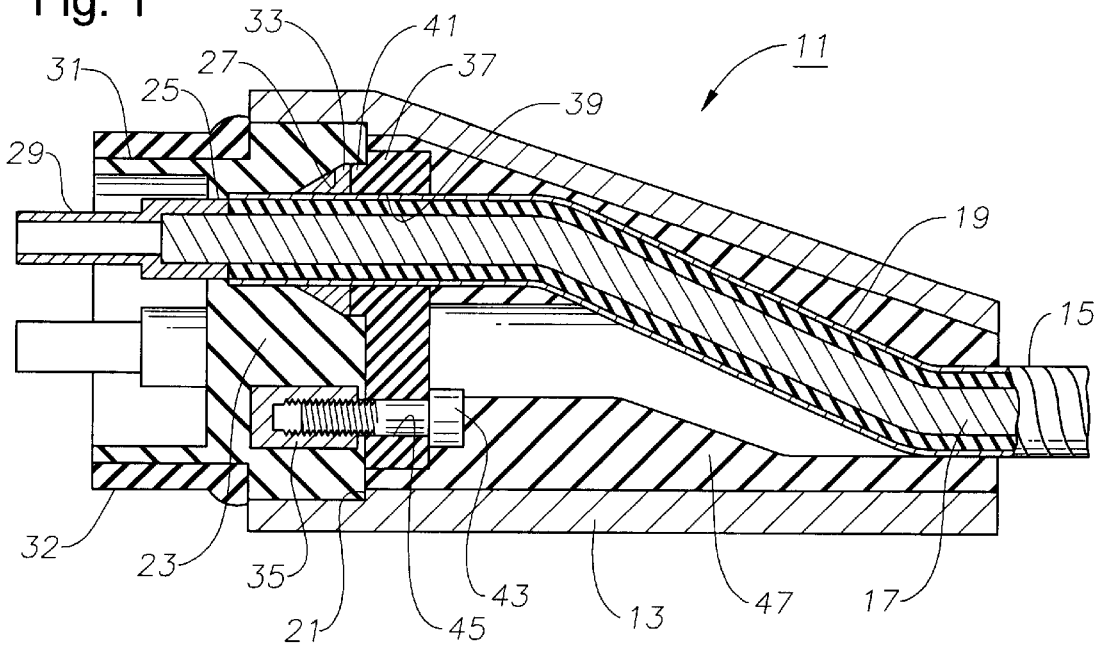
FIG. 1 is a sectional view of a pothead connector of the present invention.

Referring to FIG. 1, electrical connector 11 has a housing 13 that is typically metal. Housing 13 is configured to be secured to an end of a motor lead portion of a power cable 15 of a downhole electrical submersible motor (not shown). Motor lead 15 has three electrical conductors (only two shown) in the preferred embodiment. Each conductor 17 has one or more layers of electrical insulation 19. Conductors 17 extend into housing 13 through a passage in a second or upper end.

Housing 13 has an internal shoulder 21 near its first or lower end that faces in the first direction, which is to the left, as shown in the drawings. A first insulating block 23 locates within housing 13 at the first end. First insulating block 23 has an outer diameter that is the same as the inner diameter of housing 13 at shoulder 21. The second end of first insulating block 23 abuts shoulder 21. Block 23 is formed of a rigid electrical insulating material.

First insulating block 23 has a plurality of passages 25 (only one shown), each passage 25 receiving one of the insulated conductors 17. Passage 25 has a counterbore 27 located on the second end of insulating block 23. In the preferred embodiment, each counterbore 27 has a conical portion leading to a short cylindrical portion that joins the second end of first insulating block 23. Counterbores 27 could be of different configurations, even completely cylindrical. The remaining portion of each passage 25 closely receives one of the insulating conductors 17.

An electrical contact pin 29 is secured to the first end of conductor 17. Pin 29 may be secured by soldering or crimping to conductor 17. Pin 29 in this embodiment is shown to be hollow for receiving a mating pin in the submersible pump motor (not shown), but it could also be a solid male pin.

First insulating block 23 has a thin, cylindrical lip 31 integrally formed on it that protrudes forward past the first end of housing 13. Lip 31 is formed of the same dielectric material as insulating block 23. Lip 31 terminates short of the ends of pins 29 and is configured for reception within a mating receptacle of the pump motor. A seal 32 is located on lip 31 for sealing within the mating receptacle of the pump motor. Seal 32 is shown to be a flat elastomeric member, but it could also be an o-ring. Seal 32 is much softer than lip 31, although both are formed of dielectric materials. Lip 31 has a smaller outer diameter than the first end of housing 13.

An elastomeric washer 33 is located in counterbore 27. Washer 33 is formed of a deformable electrical insulation material. Washer 33 has a central hole that closely receives insulated conductor 17. Washer 33 has a configuration the same as the conical portion of counterbore 27. The larger diameter or base of washer 33 is located on the second end within the cylindrical portion of counterbore 27.

A plurality of threaded receptacles 35 (only one shown) are mounted in first insulating block 23. Receptacles 35 are bonded to the first insulating block 23 and have open ends that face the second direction. Receptacles 35 have second ends that are substantially flush with the second end insulating block 23.

A second or upper insulating block 37 formed of a rigid insulating material is also disposed in housing 13. Second insulating block 37 is also generally a cylindrical disc, but in the embodiment of FIGS. 1 and 2, has an outer diameter that is smaller than the outer diameter of first insulating block 23. The outer diameter of second insulating block 37 is spaced radially inward from the interior surface of housing 13 in the first and second embodiments. Second insulating block 37 also has three passages 39, each of the passages 39 registering with one of the passages 25 of first insulating block 23. Passages 39 in second insulating block 37 have the same diameters as passages 25 in first insulating block 23. One of the insulated conductors 17 passes through each passage 39.

A cylindrical protrusion 41 is formed on the first end of second insulating block 37 around each of the passages 39. Each protrusion 41 protrudes a distance slightly less than the cylindrical portion of counterbore 27. The outer diameter of protrusion 41 is slightly less than the inner diameter of the cylindrical portion of each counterbore 27. Each protrusion 41 thus fits within the counterbores 27 in contact with the base of one of the washers 33.

A plurality of fasteners 43 (only one shown) clamp insulating block 37 tightly to first insulating block 23. Fasteners 43 are screws or bolts, each having a head and a threaded portion. Each fastener 43 extends through a hole 45 in second insulating block 37 and threads into one of the threaded receptacles 35. Then fasteners 43 secure the first face of second insulating block 37 in tight contact with the second face of first insulating block 23. Each protrusion 41 deforms washer 33 into tight sealing engagement with insulation layer 19 of each insulated conductor 17. This tight engagement also secures each conductor 17 against movement relative to second insulating block 37. After full make up, the first end of each protrusion 41 is spaced slightly from the conical portion of counterbore 27. Epoxy 47 is pumped into the interior of housing 13 to fill all of the spaces surrounding insulated connectors 19. After curing epoxy 47 becomes a rigid dielectric material.

Electrical conductor connector 11 is constructed by inserting insulated conductors 17 from motor lead 15 into housing 13. Second insulating block 37 slides over the insulated conductors 17. Washers 33 are placed in counterbores 27, and first insulating block 23 then slides over insulating conductors 17. Pins 29 are formed on the extreme ends of conductor 17. Fasteners 43 are tightened to clamp second insulating block 37 tightly to first insulating block 23. The two insulating blocks 23, 37 are then inserted into the first end of the housing 13 until the second end of first insulating block 23 abuts shoulder 21. The interior is filled with epoxy 47, which rigidly bonds the components within housing 13.

Figure 2:
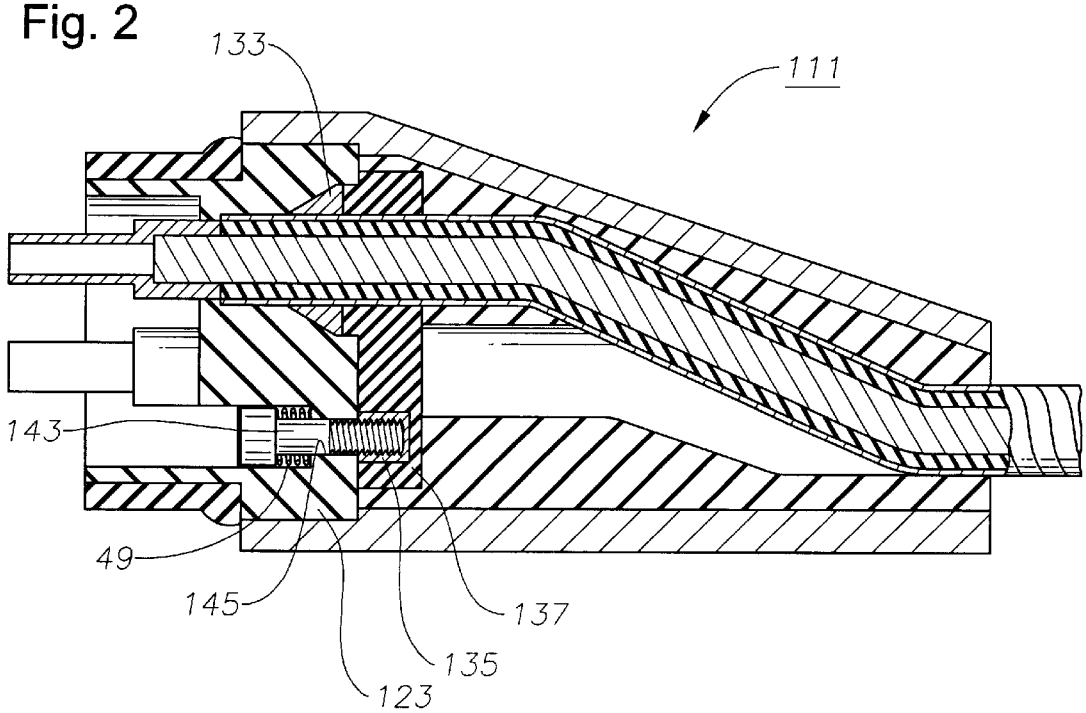
FIG. 2 is a sectional view of an alternative embodiment of the pothead connector of the present invention.

The embodiment of FIG. 2 has many similarities, and the common features will not be discussed again. The principal difference is a provision that allows thermal expansion of each washer 133. In this embodiment, threaded receptacle 135 is located within second insulating block 137. Fasteners 143 pass through holes 145 in first insulating block 123. The heads of fasteners 143 are thus located on the first or lower side. Each hole 145 has an enlarged counterbore on the first end for receiving a coil spring 49. Spring 49 is compressed between the shoulder in passage 145 and the head of fastener 143.

Should thermal expansion of washers 133 tend to force insulating blocks 23 and 137 apart from each other, springs 49 will allow a slight amount of this movement to occur. When installed, the first end of second insulating block 137 will be in abutting contact with the second end of first insulating block 123. If thermal expansion of washers 133 causes them to expand relative to the blocks 123, 137, first insulating block 123 will move slightly in the first direction relative to block 137 with springs 49 deflecting or compressing during this occurrence. This will create a slight gap between insulating blocks 137 and 123. After subsequent cooling, springs 49 will cause second insulating block 123 to again move back into the second direction until its second end contacts the first end of second insulating block 137.

Figure 3:
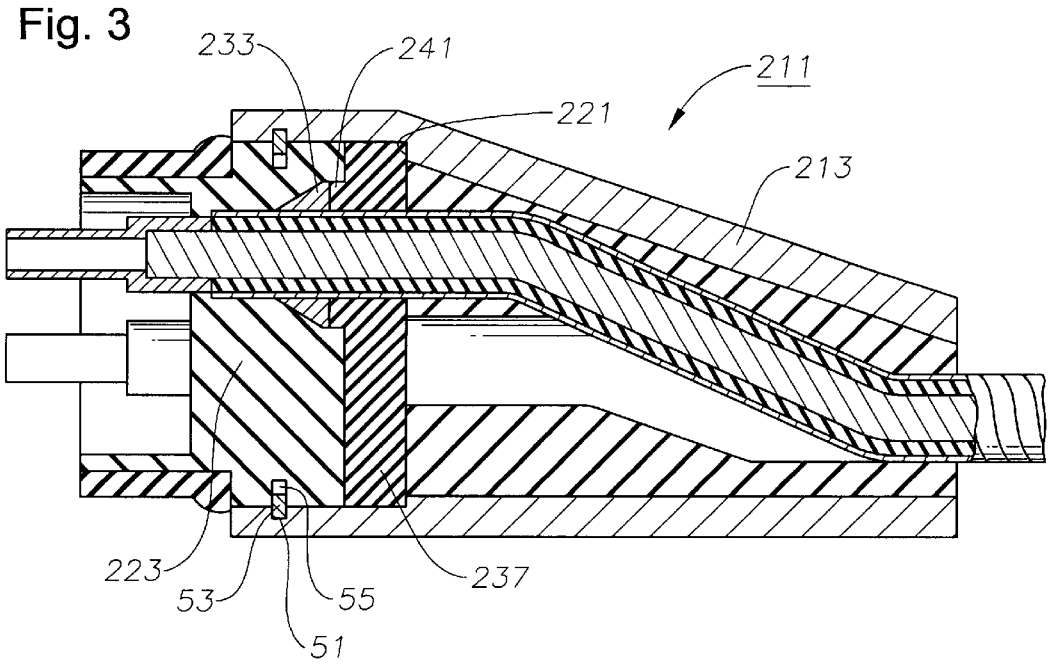
FIG. 3 is a sectional view of a second alternative embodiment of the pothead connector of the present invention.

The second alternate embodiment, shown in FIG. 3, also has a number of common components with the other embodiments. Connector 211 has the same housing 213 as housing 13 of FIG. 1, except internal shoulder 221 is located farther from the first end. In this embodiment, second insulating block 237 has a second end that abuts internal shoulder 221. The outer diameter of second insulating block 237 is the same as the outer diameter of first insulating block 223. Blocks 223 and 237 slide into the first end of housing 213 until block 237 abuts shoulder 221.

The fastener for maintaining protruding portion 241 in engagement with washers 233 differs from the threaded fasteners 43 and 143 of the other embodiments. In this embodiment, a retaining ring 53 locates within a groove 51 formed in housing 213 between the first end and internal shoulder 221. Retaining ring 53 is designed to snap into a mating recess 55 formed on the outer diameter of first insulating block 223. The operator will press first insulating block 223 tightly against second insulating block 237, the blocks moving into housing 213 until retaining ring 53 snaps into groove 51 in housing 213. This engagement will hold each washer 233 in a desired deformation due to protrusions 241.

Figure 4:
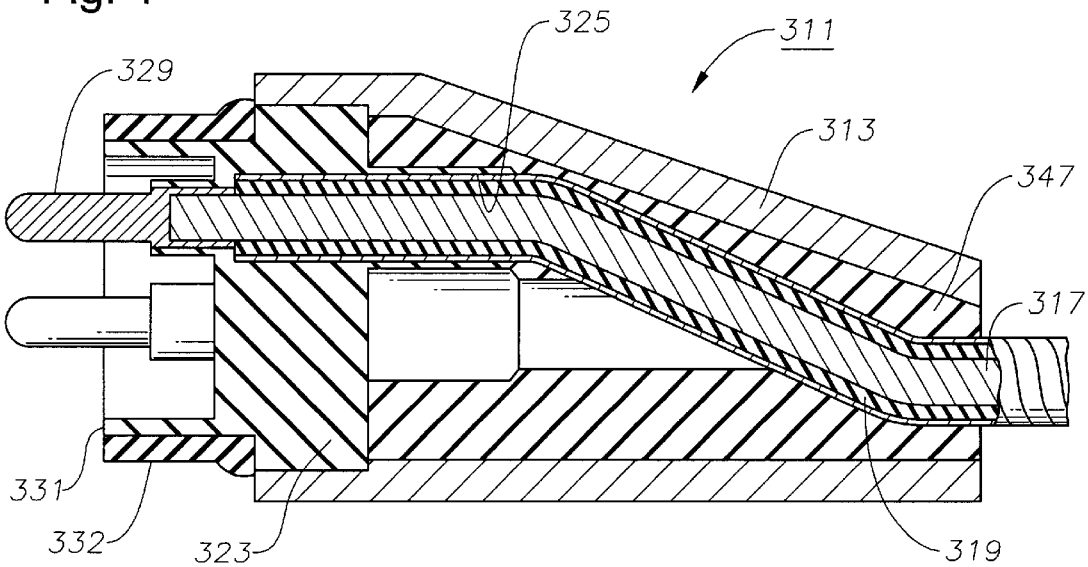
FIG. 4 is a sectional view of a third alternative embodiment of the pothead connector of the present invention.

In the embodiment of FIG. 4, electrical connector 311 has a housing 313 as in the other embodiments. A single insulating block 323 is mounted in housing 311. Insulating block 323 is rigid and has a thin, cylindrical lip 331 that protrudes forward past housing 311 as in the other embodiments. Insulating block 323 has a passage 325 for each of the conductors 317. Each conductor 317 has one or more insulation layers 319 that slide closely inside passage 325. An electrical contact pin 329 is secured to each conductor 317 and protrudes past insulating block 323 and lip 331.

Insulating block 323 and insulation layer 319 are made of compatible thermoplastic materials. After insulation layers 319 are inserted into passages 325, heat is applied to cause slight melting of the materials at the interface between insulation layers 319 and passages 325 of insulating block 323. When cooled, the materials thermally fuse together. During manufacturing, conductors 317 are threaded through housing 313 and into passages 325 of block 323 while housing 313 is pushed rearward of block 323. Then heat is applied to cause insulation layers 319 to fuse to block 323. Then block 323 is pushed into housing 313 and epoxy 347 placed in the spaces in housing 313 around conductors 317. Epoxy 347 rigidly secures block 323 to housing 313. The fused insulation layers 319 seal and secure conductors 317 to block 323. Examples of suitable thermoplastic materials for layer 319 and insulating block 323 include, but are not limited to the following: polyvinylchloride (PVC), polyethylene, polypropylene, fluorinated ethylene propylene (FEP), tetrafluoroethylene as a co-polymer with a fully fluorinated alkoxy (PFA), or perfluoromethylvinylether as a co-polymer with tetraflourofluoroethylene (MFA). These thermoplastics are known insulation materials for electrical power cable for downhole centrifugal pumps. Also, it is not necessary that insulating block 323 and insulation layer 319 be the same material, only that they are sufficiently compatible to thermally fuse together.

The invention has significant advantages. The protruding cylindrical lip of the insulating block provides additional dielectric thickness over the prior art, which employed a metal housing lip surrounded by a seal. The elastomeric washer provides an effective seal formed by the two insulators. The thermal fusing of the insulation layer to the insulating block seals as well as providing rigidity.

It is to be understood that the invention is not limited to the exact details of the construction, operation, exact materials or embodiment shown and described, as obvious modifications and equivalents will be apparent to one skilled in the art. For example, all of the embodiments show the conical counterbore located in the first insulating block. It should be apparent that the counterbore could alternately be located in the second insulating block. In that instance, the protrusions would be located on the second end of the first insulating block.

I claim:

1. An electrical connector for a cable having at least one insulated conductor, the connector comprising:

a housing;

a rigid insulating block of insulating material disposed within the housing and having a passage for receiving an insulated conductor of the cable;

a cylindrical lip of the same insulating material as the insulating block integrally formed on an end of the insulating block and protruding past an end of the housing for insertion into a mating receptacle, the lip having an outer diameter and an inner diameter that are concentric relative to an axis of the insulating block;

an electrical contact pin mounted in the insulating block and adapted to be joined to the cable, the pin protruding past the cylindrical lip for mating engagement with an electrical contact in the receptacle; and an elastomeric seal extending around an the outer diameter of the cylindrical lip for sealing in the mating receptacle.

2. The connector of claim 1, wherein the elastomeric seal is of softer material than the cylindrical lip.

3. The connector of claim 1, wherein the outer diameter of the cylindrical lip is smaller than the end of the insulating block.

4. An electrical connector for a cable having at least one insulated conductor, the connector comprising:

a housing;

a rigid insulating block of insulating material disposed within the housing and having a passage for receiving an insulated conductor of the cable;

a cylindrical lip of the same insulating material as the insulating block integrally formed on a first end of the insulating block and protruding past an end of the housing for insertion into a mating receptacle;

an electrical contact pin mounted in the insulating block and adapted to be joined to the cable, the pin protruding past the cylindrical lip for mating engagement with an electrical contact in the receptacle;

an elastomeric seal extending around an outer diameter of the cylindrical lip for sealing in the mating receptacle;

a second insulating block disposed within the housing, the second insulating block having a passage for receiving the insulated conductor, the second insulating block having a first end that faces a second end of said first mentioned insulating block;

a counterbore in one of the passages of one of the insulating blocks;

a protrusion on the other insulating block that is concentric with and locates within at least a portion of the counterbore;

a washer formed of deformable dielectric material and positioned within the counterbore, the washer having a hole for receiving the insulated conductor; and a fastener that secures the second insulating block to said first mentioned insulating block, forcing the protrusion against the washer to cause the washer to seal around the insulated conductor.

5. The electrical connector of claim 4, wherein:

the fastener comprises a threaded connector extending between the second insulating block and the first mentioned insulating block.

6. An electrical connector for a cable having at least one insulated conductor, the connector comprising:

a housing;

a first insulating block disposed within the housing and having first and second ends, the first insulating block having a passage for receiving an insulated conductor of the cable;

an electrical contact pin mounted in and protruding from the first end of the first insulating block, the contact pin adapted to be joined to the conductor of the cable;

a second insulating block disposed within the housing, the second insulating block having a passage for receiving the insulated conductor, the second insulating block having a first end that faces the second end of the first insulating block;

a counterbore in one of the passages of one of the insulating blocks;

a protrusion on the other insulating block that is concentric with and locates within at least a portion of the counterbore;

a washer formed of deformable dielectric material and positioned within the counterbore, the washer having a hole for receiving the insulated conductor; and a fastener that secures the second insulating block to the first insulating block, forcing the protrusion against the washer to cause the washer to seal around the insulated conductor.

7. The electrical connector of claim 6, wherein:

the housing has a shoulder on an interior surface; and the second insulating block engages the shoulder and is retained against the shoulder by the fastener.

8. The electrical connector of claim 6, wherein:

the fastener comprises a threaded connector extending between the second insulating block and the first insulating block.

9. The electrical connector of claim 6, wherein:

the washer is conical with a base contacted by the protrusion.

10. The electrical connector of claim 6, further comprising a cylindrical lip integrally formed on a the first end of the first block and protruding past a first end of the housing; and a seal located on an outer diameter of the cylindrical lip.

11. The electrical connector of claim 8, wherein:

the threaded connector passes through the second insulating block into a threaded receptacle in the first insulating block.

12. The electrical connector of claim 8, wherein:

the threaded connector passes through the first insulating block into a threaded receptacle in the second insulating block.

13. An electrical connector for a cable having a plurality of insulated conductors, comprising:

a housing;

a first insulating block disposed within the housing, the first insulating block having a plurality of passages, each for receiving an insulated conductor of the cable, each of the passages having a counterbore;

a plurality of electrical conductor pins adapted to be joined to the conductors, each of the conductor pins mounted in the first insulating block and protruding therefrom;

a second insulating block disposed within the housing, the second insulating block having a plurality of passages, each for receiving one of the insulated conductors, the second insulating block having a plurality of protrusions, each of which is concentric with and located within one of the counterbores in the first insulating block;

a washer of deformable electrical insulation material positioned within each of the counterbores, each washer having a hole for receiving one of the insulated conductors; and a threaded fastener extending between the second insulating block and the first insulating block, securing the second insulating block to the first insulating block and pushing the protrusions on the second insulating block into the washers in the counterbores to deform the washers into sealing engagement with the insulated conductors.

14. The electrical connector of claim 13, wherein:

the threaded fastener extends through the second insulating block into a threaded receptacle in the first insulating block.

15. The electrical connector of claim 13, wherein:

the housing has a shoulder on an interior surface;

the first insulating block abuts the shoulder; and the second insulating block has a smaller outer diameter than the first insulating block, the outer diameter of the second insulating block being spaced inward from the interior surface of the housing.

16. The electrical connector of claim 13, wherein:

the washers are conical, each having a base that is contacted by one of the protrusions of the second insulating block.

17. The electrical connector of claim 13, wherein:

the first insulating block has a thin, cylindrical lip integrally formed thereon that extends beyond a first end of the housing; and a seal is located on an outer diameter of the cylindrical lip.

* * * * *